US009010166B2

(12) United States Patent
Brennand

(10) Patent No.: US 9,010,166 B2
(45) Date of Patent: Apr. 21, 2015

(54) FORMING APPARATUS

(75) Inventor: Phillip Brennand, Barnoldswick (GB)

(73) Assignee: Rolls-Royce plc, London (GB)

( * ) Notice: Subject to any disclaimer, the term of this patent is extended or adjusted under 35 U.S.C. 154(b) by 645 days.

(21) Appl. No.: 12/585,203

(22) Filed: Sep. 8, 2009

(65) Prior Publication Data

US 2010/0116013 A1 May 13, 2010

(30) Foreign Application Priority Data

Nov. 10, 2008 (GB) ..... 0820424.0

(51) Int. Cl.
*B21D 11/14* (2006.01)
*B21D 53/78* (2006.01)
*B21D 22/02* (2006.01)

(52) U.S. Cl.
CPC ..... *B21D 53/78* (2013.01); *B21D 22/02* (2013.01); *B21D 11/14* (2013.01)

(58) Field of Classification Search
CPC ..... B21D 11/14; B21D 3/12; B21D 53/78; B21J 3/02; B21K 3/04
USPC ..... 72/299, 301, 302, 371, 342.1–342.94; 29/889.7, 889.72
See application file for complete search history.

(56) References Cited

U.S. PATENT DOCUMENTS 3,280,607 A * 10/1966 Whitmore et al. ..... 72/14.9
5,063,662 A 11/1991 Porter et al.
5,636,440 A 6/1997 Bichon et al.
5,933,951 A * 8/1999 Bergue et al. ..... 29/889.72
6,959,572 B2 * 11/2005 Lawrence et al. ..... 72/31.03

FOREIGN PATENT DOCUMENTS

| | | |
|---|---|---|
| EP | 0 448 339 A1 | 9/1991 |
| EP | 0 700 738 A1 | 3/1996 |
| JP | A-63-252635 | 10/1988 |
| SU | 803225 | 5/1982 |

OTHER PUBLICATIONS

May 23, 2013 Search Report issued in European Application No. 09 25 2147.

* cited by examiner

*Primary Examiner* — Shelley Self
*Assistant Examiner* — Matthew G Katcoff
(74) *Attorney, Agent, or Firm* — Oliff PLC

(57) ABSTRACT

A forming apparatus (20) and method are provided for forming an item (10). The item includes an end part (12), a body part (14) and a tip (16), the body part extending from the end part, the tip being located at an end of the body part remote from the end part. The invention is characterized in that the apparatus includes a tip holder (22) for holding the tip and an end die (26) for clamping the end part; a rotator (42) for inducing relative rotation between the end die and the tip holder which, in a twisting step, induces a twist in the body part in use; and a body die (32), the body die including one or more formation surfaces (34), the body die being arranged in use in a conformation step to conform one or more surfaces (50) of the twisted body part to the or each formation surface.

13 Claims, 2 Drawing Sheets

FORMING APPARATUS

The present invention relates to forming apparatus, and a method of forming an item.

Items such as wide chord fan blades are relatively large aerofoils situated at the inlet of a gas turbine engine. Such blades have to be constructed to withstand events such as foreign object strike and high tip speeds, while minimising weight, maximising aerofoil performance and life and minimising maintenance requirements. Typically, such blades are formed of relatively exotic materials and the manufacturing process of such blades is relatively complex, comprising many sequential steps.

Such aerofoils include a twist between the root and tip of the aerofoil. Previous methods of forming such aerofoils include a two-stage process comprising firstly gripping a blade workpiece at one end, locating the other end in a slot and twisting the blade workpiece, and then secondly transferring the workpiece to separate hot creep forming die apparatus to form the surface of the blade workpiece. However, the first stage of this process results in inconsistent blade tip position and irregularities in the blade workpiece surface, which makes locating the blade workpiece in the hot creep forming die apparatus more difficult.

According to a first aspect of the present invention, there is provided forming apparatus for forming an item, the item including an end part, a body part and a tip, the body part extending from the end part, the tip being located at an end of the body part remote from the end part, the apparatus including a tip holder for holding the tip and an end die for clamping the end part, the apparatus including a rotator for inducing relative rotation between the end die and the tip holder which, in a twisting step, induces a twist in the body part in use, the apparatus including a body die, the body die including one or more formation surfaces, the body die being arranged in use in a conformation step to conform one or more surfaces of the twisted body part to the or each formation surface.

Possibly, the body part extends along an axis from the end part to the tip, and the relative rotation is about the axis.

Possibly, the body die conforms the twisted body part by inducing creep deformation, and optimally by inducing hot creep deformation.

Possibly, the apparatus includes a heater, which may apply heat to the item. Possibly, the heater applies heat to the item during the twisting step, and may apply heat to the item during the conformation step.

Possibly the end die deforms the end part, and may camber the end part.

Possibly, the tip holder includes a pair of jaws, which may be movable relative to each other, and may be arranged to hold the tip without substantially any relative movement between the tip holder and the tip. Possibly, the apparatus includes a mounting for mounting the tip holder. Possibly, the mounting permits movement of the tip holder towards and away from the end die.

Alternatively or additionally, the jaws may be arranged to receive the tip therebetween while permitting relative movement between the tip holder and the tip. The permitted relative movement may be along the axis.

Possibly, the item is a blade workpiece in the manufacture of an aerofoil, which may be an aerofoil for a gas turbine engine. Possibly the aerofoil is a wide chord fan blade. Possibly, the item is formed of titanium, or a titanium alloy.

According to a second aspect of the present invention, there is provided a method of forming an item, the item including a end part, a body part and a tip, the tip being located at an end of the body part remote from the end part, the method including a step of holding the tip and clamping the end part, a twisting step in which one of either the tip or the end part or both is rotated relative to the other to induce a twist in the body part, and a conformation step in which the twisted body part is conformed to one or more formation surfaces.

Possibly, the method includes the step of heating the item. Possibly, the item is heated during the twisting step. Possibly, the item is heated during the conformation step.

Possibly, in the conformation step, the twisted body part is conformed by creep deformation, and may be deformed by hot creep deformation. Possibly, in the conformation step, heat and/or pressure is applied to the twisted body part to cause creep deformation. Possibly, in the conformation step, the heat and/or the pressure is applied only to the twisted body part to cause creep deformation, and is substantially not applied to the tip.

Possibly, the clamping of the end part cambers the end part.

Possibly, the holding of the tip and the clamping of the end part is maintained throughout the twisting step and the conformation step.

Possibly, the holding of the tip is arranged so that movement of the tip towards and away from the end part is permitted.

Possibly, the method includes the use of forming apparatus according to any of the preceding statements.

According to a third aspect of the present invention, there is provided an item, the item being formed by a method according to any of the preceding statements.

According to a fourth aspect of the present invention, there is provided an item, the item being formed by forming apparatus according to any of the preceding statements.

According to a fifth aspect of the present invention, there is provided a gas turbine engine, the gas turbine engine including an item formed by a method according to any of the preceding statements or formed by forming apparatus according to any of the preceding statements.

An embodiment of the present invention will now be described by way of example only and with reference to the accompanying drawings in which.

Figure 1:
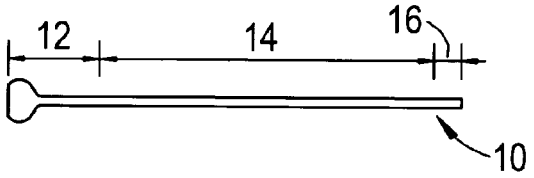
FIG. 1 is a side view of a workpiece.

Referring to FIG. 1, there is provided an item in the form of a blade workpiece 10, the blade workpiece 10 including an end part in the form of a root part 12, a body part 14 extending from the root part 12, and a tip 16 which is located at an end of the body part 14 remote from the root part 12. The body part 14 extends from the root part 12 along an axis 44.

In one example, the blade workpiece 10 could be a workpiece in the manufacture of an aerofoil, which could be a wide chord fan blade, and which could be for a gas turbine engine. The workpiece 10 could be formed of titanium, or a titanium alloy.

Figure 2:
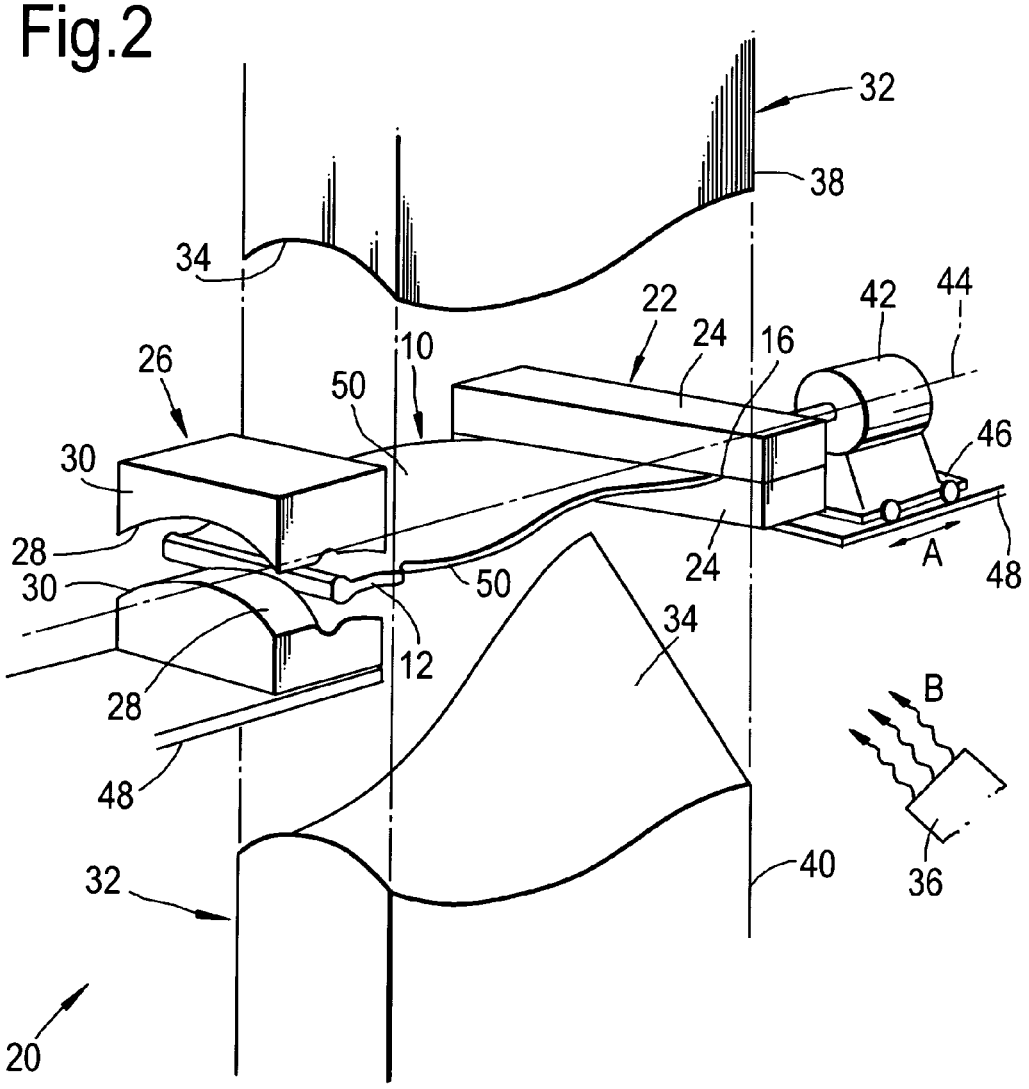
FIG. 2 is a schematic perspective view of part of a forming apparatus in use in a loading step.
Figure 3:
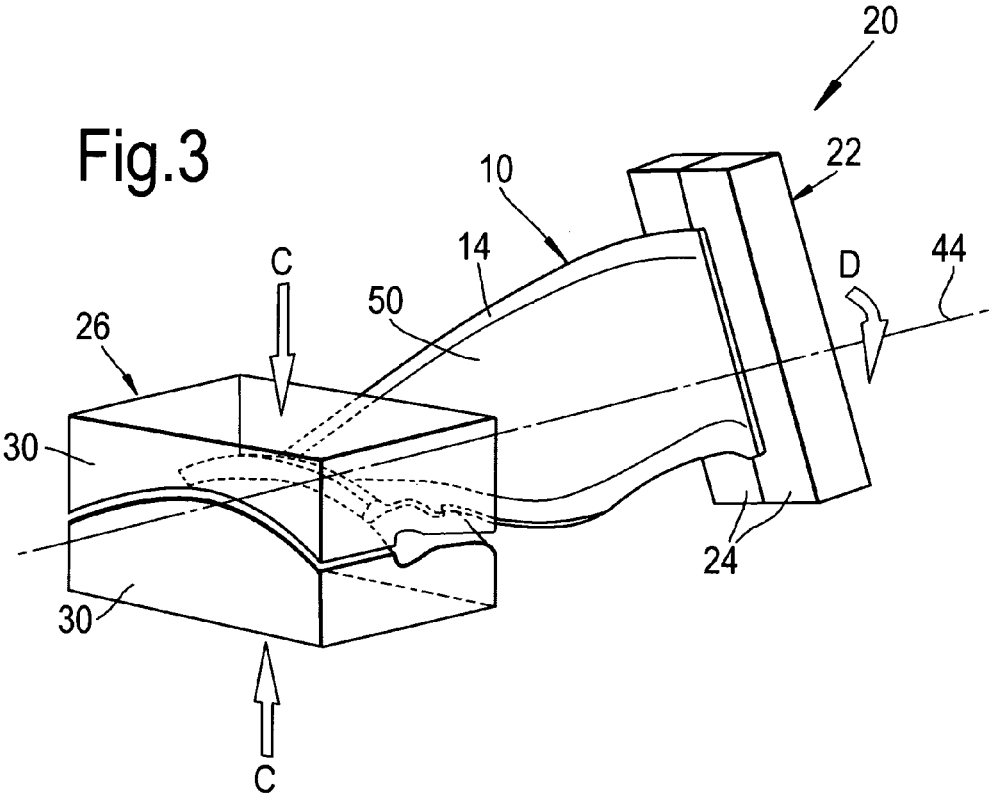
FIG. 3 is a schematic perspective view of part of the forming apparatus of FIG. 2 in use during a twisting step.
Figure 4:
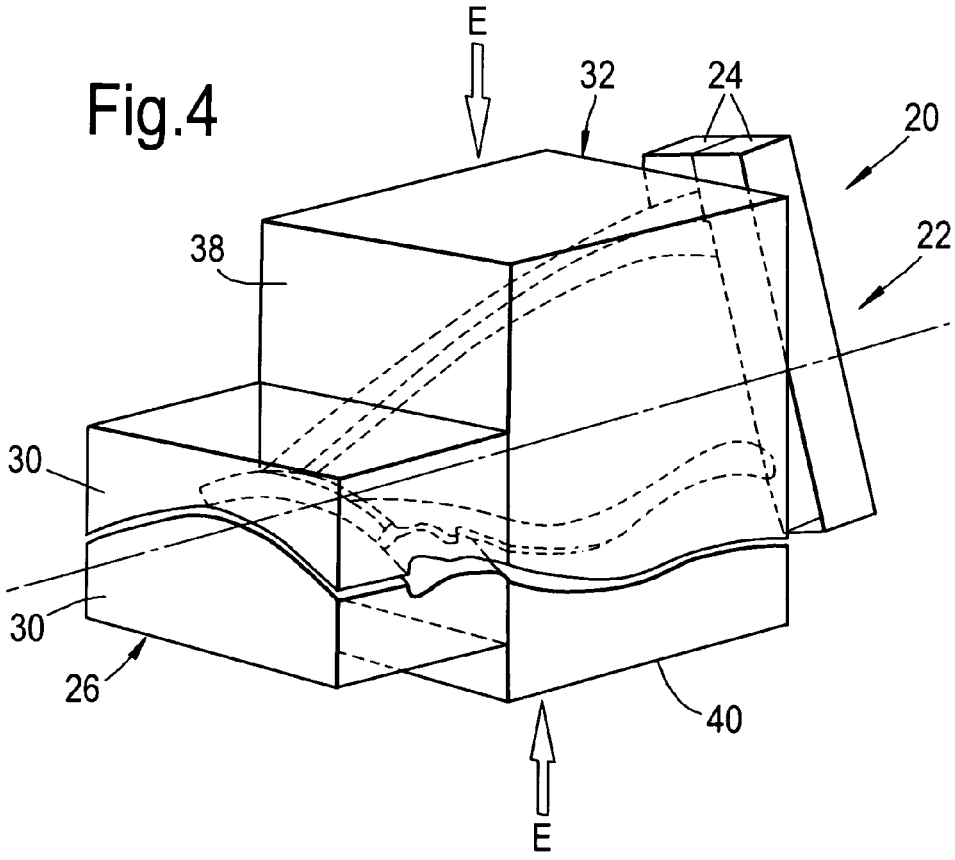
FIG. 4 is a schematic perspective view of the forming apparatus in use during a conformation step.

Referring to FIGS. 2 to 4, forming apparatus 20 includes a tip holder 22, the tip holder 22 comprising a pair of jaws 24.

The forming apparatus 20 includes a root die 26, comprising a pair of root die jaws 30, each of the root die jaws 30 including cambered formation surfaces 28.

The forming apparatus 20 includes a body die 32, the body die 32 including an upper part 38 and the lower part 40, each of the upper and lower parts 38, 40 including body formation surfaces 34.

The forming apparatus 20 includes a heater 36. The heater 36 could be of any suitable form.

The forming apparatus 20 includes a rotator 42 for inducing relative rotation between the root die 26 and the tip holder 22 around an axis 44.

The forming apparatus 20 includes a tip holder mounting 46, which movably mounts the tip holder 22 to an apparatus mounting 48. In this example, the root die 26 is mounted in a fixed position to the apparatus mounting 48.

In use, in a loading step, the workpiece 10 is loaded into the apparatus 20. The tip 16 is located between the tip holder jaws 24, which are brought together to a gripping position to grip the tip 16. In one example, the tip holder jaws 24 grip the tip 16 so as to substantially prevent relative movement between the tip 16 and the tip holder jaws 24.

In the loading step, the root part 12 is located between the root die jaws 30, and the body part 14 is located between the upper and lower parts 38, 40 of the body die 32.

In a camber forming step, with the tip holder jaws 24 still in the gripping position, the root die jaws 30 are brought together as indicated by arrows C in FIG. 3 to a clamping position so that the cambered formation surfaces 28 of the root die jaws 30 form a corresponding camber or curve in the root part 12. During this step, heat (indicated by arrows B in FIG. 2) could be applied by the heater 36 to the workpiece 10 or more specifically to the root part 12.

In a twisting step, with the tip holder jaws 24 still in the gripping position and the root die jaws 30 still in the clamping position, the rotator 42 induces rotation of the tip holder 22 relative to the root die 26 around the axis 44 to a twisted position as indicated by arrow D in FIG. 3, to form a twist in the body part 14. During this step, heat (indicated by arrows B in FIG. 2) is applied by the heater 36 to raise the temperature of the body part 14 to approximately 800° C.

In one example, the tip holder 22 rotates through an angle of approximately 70° relative to the root die 26.

During the twisting step, the movable tip holder mounting 46 permits movement of the tip holder 22 towards and away from the root die 26 along the axis 44, as indicated by the double headed arrow A in FIG. 2. As the body part 14 is twisted, the tip holder 22 moves towards the root die 26.

In a conformation step, with the tip holder jaws 24 still in the gripping position, the tip holder 22 in the twisted position and the root die jaws 30 still in the clamping position, the upper and lower die parts 38, 40 of the body die 32 are brought together as indicated by arrows E in FIG. 4 to a forming position to conform surfaces 50 of the body part 14 to the body formation surfaces 34 of the upper and lower die parts 38, 40.

During this step, heat (indicated by arrows B in FIG. 2) is applied by the heater 36 to heat the body part 14 to a temperature of approximately 750° C. The combination of the heat, and the pressure applied by the body formation surfaces 34 causes hot creep deformation of the body part 14, so that the body part surfaces 50 conform to the body formation surfaces 34. The heat and pressure is applied only to the body part 14, causing creep deformation only of the body part 14, and substantially not of the tip 16.

The forming apparatus 20 of the invention, and the method of the invention described above, produces a workpiece 10 of higher and more consistent quality than previous methods and apparatus. The gripping of the tip 16 during the conformation step results in a more consistent "stretch" of the workpiece, giving a more consistent blade tip position, while reducing or eliminating the surface irregularities previously experienced. As the tip 16 is not substantially subjected to hot creep deformation, the positioning and dimensions of the blade tip 16 are more consistent. The more consistent positioning of the blade tip results in higher productivity in subsequent forming processes. The more consistent dimensions of the blade tip permit a saving in material since less material is initially required at the tip of the workpiece. The more consistent deformation enables initial workpiece sizes to be determined more easily and efficiently, reducing time to market in the development of new designs.

Various modifications could be made without departing from the scope of the invention. The apparatus and/or the method could be used to form any suitable item, formed of any suitable material, of any suitable shape and size.

The rotator could be of any suitable design. The rotator could induce rotation of the root die, the tip holder or both. The tip holder mounting could be of any suitable design.

Any suitable means could be used to move the tip holder jaws, the root die jaws and the parts of the body die.

In one example, the tip 16 locates between the jaws 24 of the tip holder 22, but the jaws 24 are arranged to permit relative movement between the tip holder 22 and the tip 16. Thus, the jaws 24 do not grip the tip 16. In this example, the tip holder 22 could be fixed in position relative to the root die 26. During the twisting step, the tip 16 partially withdraws from between the jaws 24.

In another example, the tip holder 22 could be arranged so that in one position the jaws 24 do not grip the tip 16 but allow relative movement thereof, and in another position, the jaws 24 grip the tip 16 to substantially prevent relative movement thereof.

In another example, the tip holder 22 could locate and grip in use the tip 16, and the root die 26 could be movably mounted to the apparatus mounting 48.

Although the steps described above have been described as separate sequential steps, it may be possible to overlap the steps. For example, the root die jaws 30 may be brought together while the tip holder jaws 24 are being brought together. The rotator 42 may begin to rotate the tip holder 22 while the cambered formation surfaces 28 are forming the camber in the root part 12.

There is thus provided forming apparatus and a method of forming an item which provides a number of advantages over conventional apparatus and methods. In comparison with conventional methods, one process stage is removed, so that the method is more efficient. The product produced is more consistent in surface quality and size, reducing problems such as wear and deposition in subsequent processing steps. The more consistent size permits material savings and a reduction in development time for new products.

The invention claimed is:

1. A forming apparatus for forming a blade workpiece, the blade workpiece including a root part, a body part extending from the root part and a tip at an end of the body part remote from the root part, the apparatus comprising:

a tip holder configured to hold the tip;

a root die configured to clamp the root part;

a rotator configured to rotate the tip holder relative to the root die in use; and a body die, the body die including an upper die part and a separate lower die part, each of the upper die part and the lower die part having a respective formation surface, the upper die part and the lower die part each being moveable relative to the body part and towards each other so as to bring the formation surfaces into contact with surfaces of the body part after rotation of the tip holder by the rotator, the formation surfaces being arranged to extend over substantially all of the surfaces of the body part in use, so as to conform the surfaces of the body part to the formation surfaces.

2. The forming apparatus according to claim 1, wherein the body part extends along an axis from the root part to the tip, and the relative rotation is about the axis.

3. The forming apparatus according to claim 1, wherein the body die conforms the surfaces of the body part by inducing creep deformation.

4. The forming apparatus according to claim 1, wherein the apparatus includes a mounting for mounting the tip holder.

5. The forming apparatus according to claim 4, wherein the mounting permits movement of the tip holder towards and away from the root die.

6. A method of forming a blade workpiece, the blade workpiece including a root part, a body part extending from the root part and a tip at an end of the body part remote from the root part, the method comprising:

gripping the tip in a loading step;

clamping the root part in a camber forming step;

rotating the tip relative to the root part to induce a twist in the body part using a rotator, in a twisting step; and bringing separate upper and lower die parts of a body die into contact with the body part by moving each of the upper and lower die parts relative to the body part by bringing the upper and lower dies parts together so as to conform the surfaces of the body part to respective formation surfaces of the upper and lower die parts, in a conforming step, the conforming step being performed after the twisting step, the formation surfaces being arranged so as to extend over substantially all of the surfaces of the body part when the upper and lower die parts are brought into contact with the body part.

7. The method according to claim 6, further comprising:

heating the workpiece during the twisting step and/or during the conforming step.

8. The method according to claim 6, wherein in the conforming step, the surfaces of the body part are conformed by creep deformation.

9. The method according to claim 6, wherein the clamping of the root part cambers the root part.

10. The method according to claim 6, wherein the gripping of the tip and the clamping of the root part is maintained throughout the twisting step and the conforming step.

11. The method according to claim 6, wherein the gripping of the tip is arranged so that movement of the tip towards and away from the root part is permitted.

12. The apparatus according to claim 1, wherein the blade workpiece defines a plane, and the formation surface of the upper die part contacts a first surface of the plane, and the formation surface of the lower die part contacts a second surface of the plane, opposite the first surface of the plane.

13. The method according to claim 6, wherein the blade workpiece defines a plane, and the formation surface of the upper die part contacts a first surface of the plane, and the formation surface of the lower die part contacts a second surface of the plane, opposite the first surface of the plane.

* * * * *